US007121438B2

(12) United States Patent
Hoepner et al.

(10) Patent No.: US 7,121,438 B2
(45) Date of Patent: Oct. 17, 2006

(54) MULTIPLE LID CLOSURE WITH OPEN LID RETENTION FEATURE

(75) Inventors: Travis J. Hoepner, Mukwonago, WI (US); Christopher A. Danks, Waukesha, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/943,348

(22) Filed: Sep. 17, 2004

(65) Prior Publication Data

US 2006/0060618 A1 Mar. 23, 2006

(51) Int. Cl.
*B65D 47/00* (2006.01)

(52) U.S. Cl. ..... 222/544; 222/480; 220/254.2

(58) Field of Classification Search ..... 222/556, 222/480, 565, 153.14, 478, 481, 482, 485, 222/544, 545, 546; 220/254.2–254.6; D9/447, D9/449

See application file for complete search history.

(56) References Cited

U.S. PATENT DOCUMENTS 3,140,019 A * 7/1964 Barr ..... 222/480
3,217,949 A 11/1965 Davis
3,542,245 A 11/1970 Hidding
4,029,202 A 6/1977 Lasich et al.
4,106,672 A 8/1978 Tecco et al.
4,163,496 A 8/1979 Dogliotti
4,361,250 A 11/1982 Foster
4,369,901 A 1/1983 Hidding
D272,807 S * 2/1984 Ruhl ..... D9/449
4,488,667 A * 12/1984 Swett et al. ..... 222/485
4,658,980 A 4/1987 Lindstrom
4,693,399 A * 9/1987 Hickman et al. ..... 222/480
4,723,693 A 2/1988 DeCoster
4,881,668 A 11/1989 Kitterman et al.
D305,206 S 12/1989 Hickman et al.
4,898,292 A 2/1990 VerWeyst et al.
4,936,494 A 6/1990 Weldman
4,955,513 A 9/1990 Bennett
5,048,730 A 9/1991 Forsyth et al.
5,219,100 A 6/1993 Beck et al.
5,330,082 A 7/1994 Forsyth
5,339,993 A 8/1994 Groya et al.
5,415,312 A 5/1995 Mueller
5,465,871 A 11/1995 Robbins, III
5,487,494 A 1/1996 Robbins, III
5,509,582 A 4/1996 Robbins, III
5,542,579 A 8/1996 Robbins, III
5,547,109 A 8/1996 Robbins, III
5,632,417 A 5/1997 Robbins, III et al.
5,706,981 A 1/1998 Nobakht
5,799,838 A 9/1998 Miller
5,850,944 A 12/1998 Robbins, III et al.
5,897,036 A * 4/1999 DeCoster et al. ..... 222/480
D410,388 S * 6/1999 Fisher et al. ..... D9/449

(Continued)

OTHER PUBLICATIONS

Drawing No. XB-1921-C SHEET 1 of 3.

(Continued)

*Primary Examiner*—Lien M. Ngo
(74) *Attorney, Agent, or Firm*—Wood, Phillips, Katz, Clark & Mortimer

(57) ABSTRACT

A dispensing closure system is provided with two or more dispensing apertures and two or more pivotable lids. Each lid can be selectively opened and retained in a fully opened orientation. In a preferred form of the invention, the lids are incorporated in a top that is snap-fitted into a closure body which defines the dispensing apertures.

15 Claims, 9 Drawing Sheets

U.S. PATENT DOCUMENTS

| | | | | |
|---|---|---|---|---|
| 5,971,231 | A | 10/1999 | Samz et al. | |
| 6,250,517 | B1 | 6/2001 | Samz et al. | |
| 6,308,870 | B1 * | 10/2001 | Samz et al. | 222/480 |
| 6,341,720 | B1 | 1/2002 | Schmit et al. | |
| RE37,634 | E | 4/2002 | Hickman et al. | |
| 6,422,411 | B1 | 7/2002 | Gray | |
| 6,460,718 | B1 | 10/2002 | Vogel | |
| 6,464,113 | B1 | 10/2002 | Vogel | |
| 6,575,323 | B1 | 6/2003 | Martin et al. | |
| 6,616,016 | B1 | 9/2003 | Hicks et al. | |
| 6,691,901 | B1 * | 2/2004 | Parve et al. | 222/556 |
| D509,426 | S * | 9/2005 | Samz et al. | D9/447 |
| 2003/0071041 | A1 | 4/2003 | Vogel | |
| 2003/0090036 | A1 | 5/2003 | Vogel | |

OTHER PUBLICATIONS

Drawing No. XB-1921-C Sheet 1 of 3 Enlargement 1.
Drawing No. XB-1921-C Sheet 1 of 3 Enlargement 2.
Drawing No. XB-1921-C Latch Open.
Drawing No. XB-1922-C SHEET 1 of 4.
Drawing No. XDA-1925-A SHEET 1 of 1.

* cited by examiner

Fig. 4
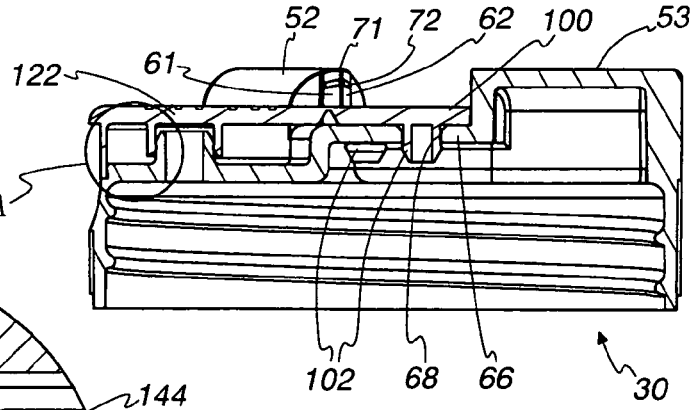
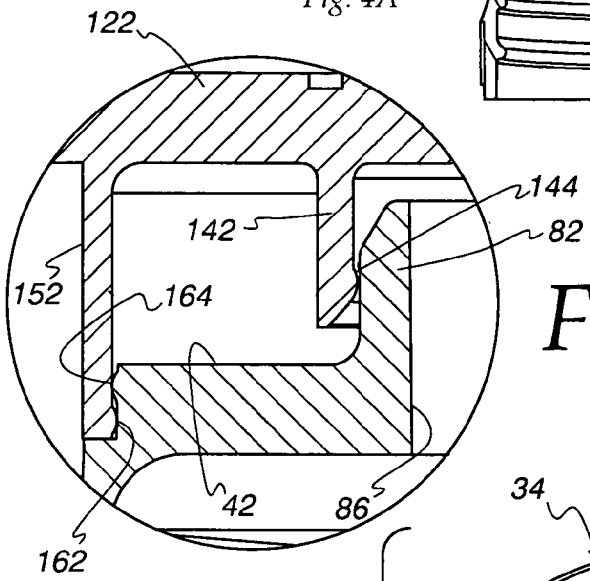
Fig. 4A
Fig. 5
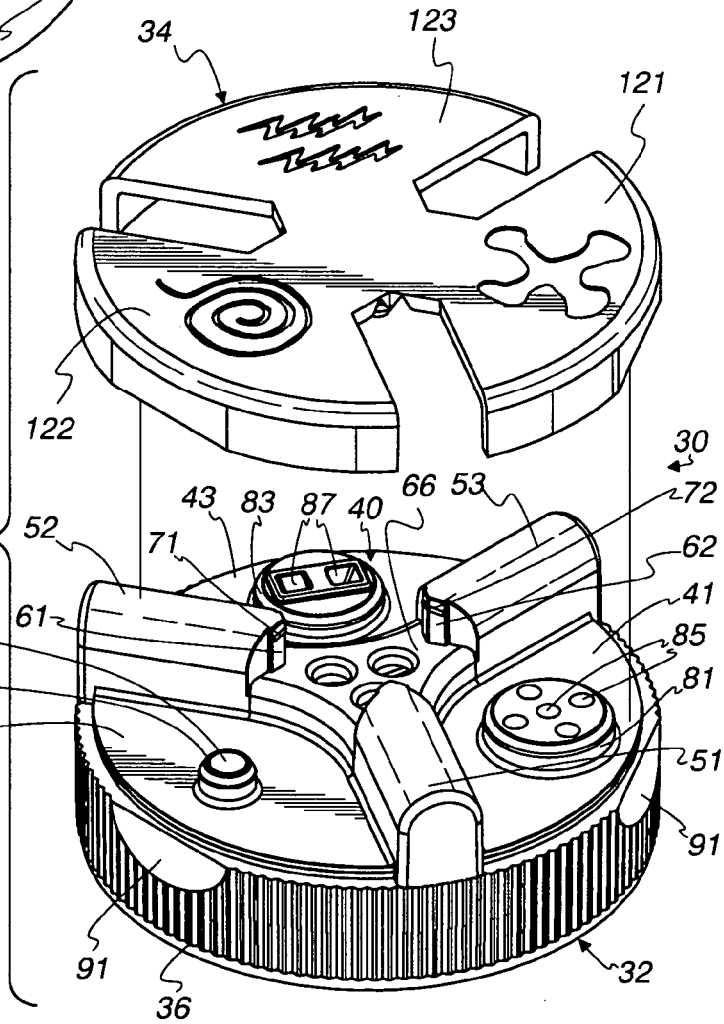

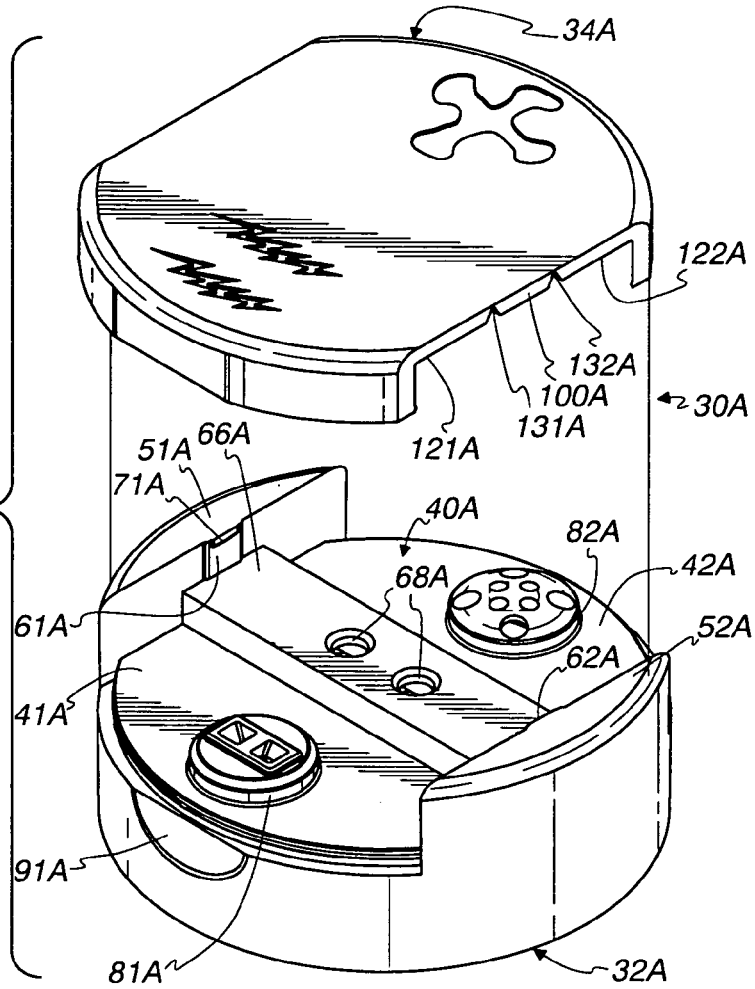
Fig. 17
Fig. 18
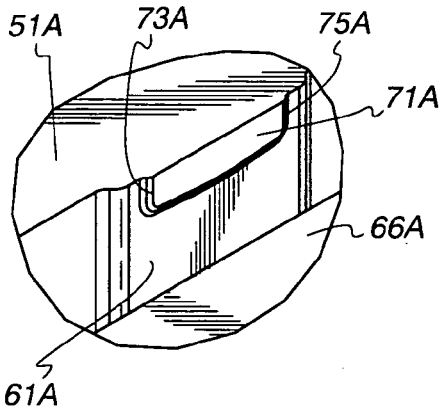
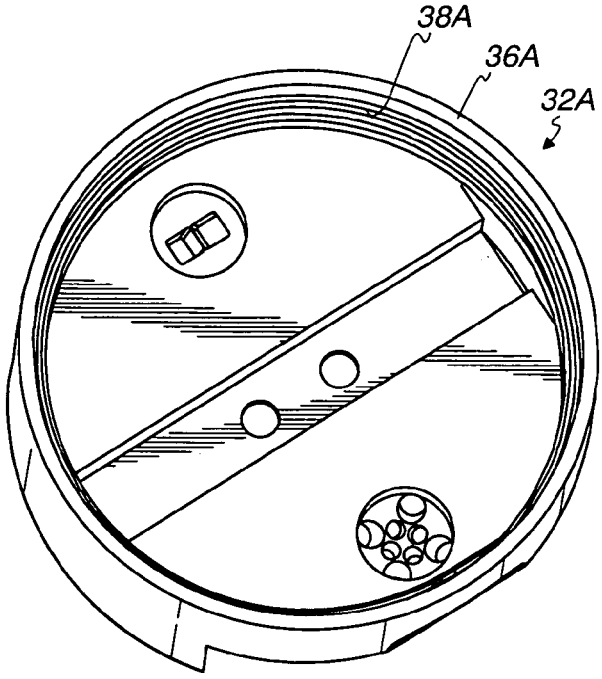
Fig. 19

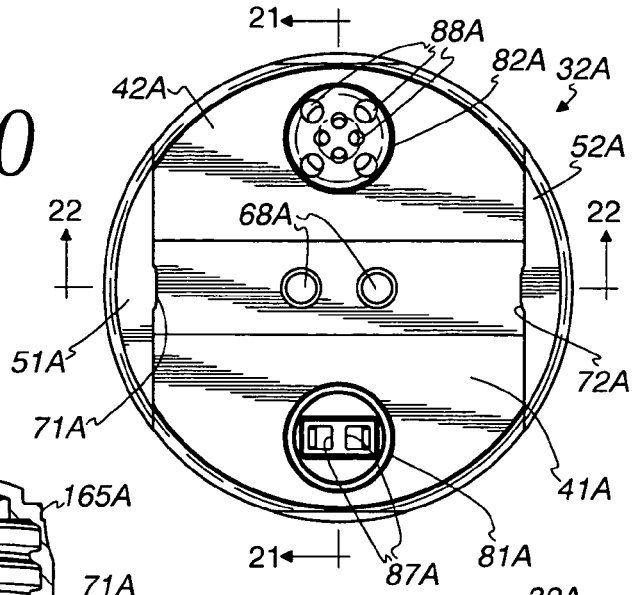
Fig. 20
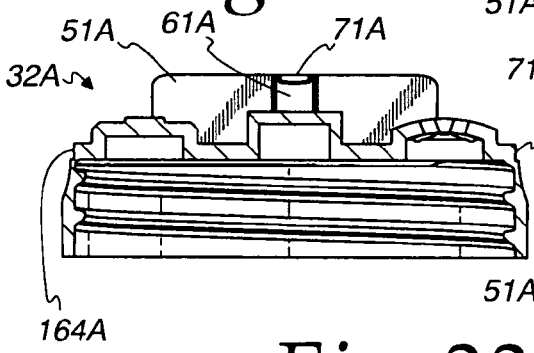
Fig. 21
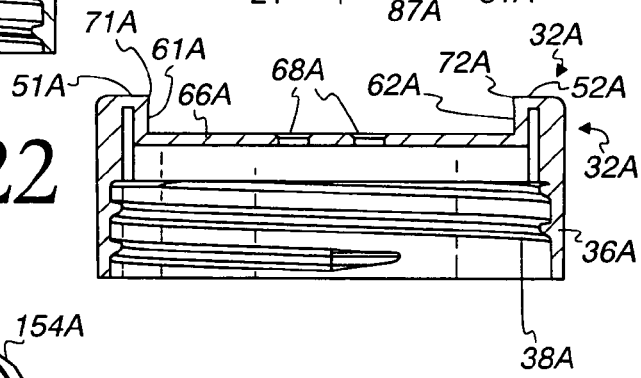
Fig. 22
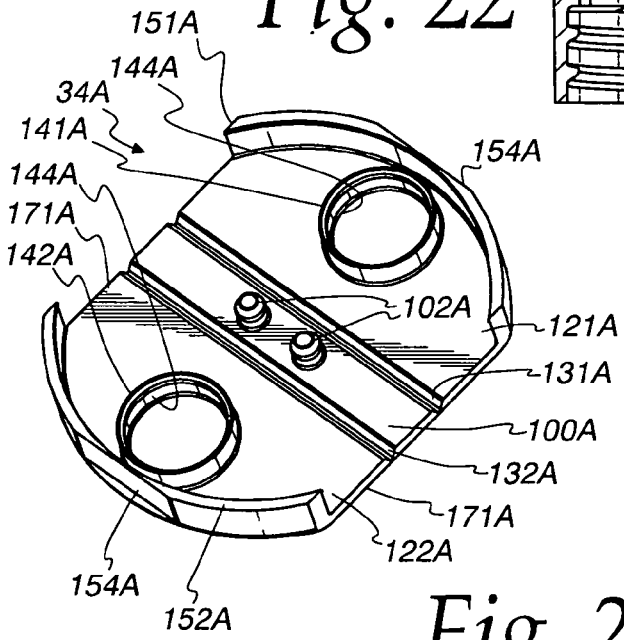
Fig. 23
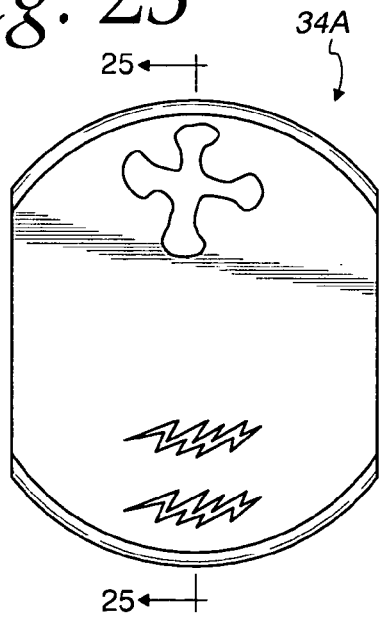
Fig. 24
Fig. 25
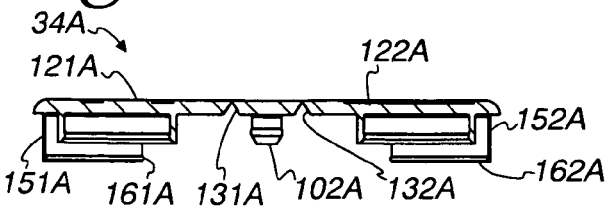

MULTIPLE LID CLOSURE WITH OPEN LID RETENTION FEATURE

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a material from a container. The invention is particularly suitable for incorporation in a dispensing closure for use with a squeezable container.

BACKGROUND OF THE INVENTION AND TECHNICAL PROBLEMS POSED BY THE PRIOR ART

There are a variety of types of conventional dispensing closures. One type of prior art dispensing closure system includes a body or base for being attached to the top of a container. The body defines a dispensing opening. The system further includes a lid which is hingedly mounted on the body and which can be lifted up to open the dispensing opening.

Dispensing closures are typically used for dispensing a fluent product from a container. With some types of fluent products, and in some applications, it may be desirable to have the body dispensing opening be substantially unobstructed around most, if not all, of the periphery when the lid is open. It is desirable for the lid to be held as far open as possible so that the lid does not hang down and interfere with the fluent product dispensing process. For example, when dispensing mustard or other fluent condiments from a container through the dispensing opening of a dispensing closure, the user does not want the open lid to contact the discharging product or contact the target area, such as a plate or food item onto which the fluent product is being dispensed.

It would be desirable to provide an improved system for maintaining a lid in an open position during the dispensing product. Further, in some applications, it may be desirable to provide a dispensing closure with multiple dispensing openings having different configurations for selectively dispensing discharge streams having different sizes or configurations. Preferably, if each separate dispensing opening has its own separate lid, a desired dispensing opening can be selected and opened by opening the associated lid while the remaining dispensing openings can remain closed with their own separate lids.

It would be desirable to provide a dispensing closure with multiple dispensing openings and multiple lids that could each be selectively and easily operated between a closed condition and a substantially wide open condition wherein the opened lid is maintained in a substantially wide open condition until the user re-closes the opened lid.

Such a multiple lid closure should accommodate ease of use. Preferably, such an improved multiple lid closure should also permit the area around the dispensing opening to be readily cleaned.

It would also be desirable to provide an improved dispensing closure system which would have components that can be easily manufactured and assembled.

It would also be beneficial if an improved dispensing closure system could readily accommodate its manufacture from a variety of different materials.

It would also be advantageous if such an improved dispensing closure system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The dispensing closure system of the present invention can accommodate designs that include one or more of the above-discussed desired features. According to one aspect of the present invention, a dispensing closure system is provided for a container that has an interior where a product may be stored. The dispensing closure system has a body for accommodating communication with the container interior. The body includes (1) a deck having at least (a) a first dispensing region defining at least one aperture from which product can be dispensed, and (b) a second dispensing region defining at least one aperture from which product can be dispensed, and (2) at least two protuberances that each (a) are located above the elevation of the deck, and (b) project laterally.

The closure system also includes at least a first lid that (1) is associated with the first dispensing region, (2) is pivotable between (a) a closed position occluding the first dispensing region aperture, and (b) a fully open position away from the closed position to permit dispensing of product from the container through the first dispensing region aperture, and (3) defines two lateral margins for each engaging and being forced past one the protuberances as the first lid is pivoted to the fully open position where the first lid is retained unless a sufficient closing force is applied to the first lid so as to move the first lid toward the closed position and force the first lid margins past the protuberances.

The closure system also includes at least a second lid that (1) is associated with the second dispensing region, (2) is pivotable between (a) a closed position occluding the second dispensing region aperture, and (b) a fully open position away from the closed position to permit dispensing of product from the container through the second dispensing region aperture, and (3) defines two lateral margins for each engaging and being forced past one the protuberances as the second lid is pivoted to the fully open position where the second lid is retained unless a sufficient closing force is applied to the second lid so as to move the second lid toward the closed position and force the second lid margins past the protuberances.

In one form of the invention, the system is a two-piece dispensing closure for a container that has an opening to the container interior, and the closure is separate from, but releasably attachable to, the container around the opening. The closure includes a body for mounting to the container, and the body defines at least the first and second dispensing regions. The closure also includes a top that is mounted to the body and that includes the first and second lids. The top also includes (1) a stationary central panel anchored to the body, (2) a first hinge connecting the first lid to the central panel, and (3) a second hinge connecting the second lid to the central panel.

The closure may also include (1) a third dispensing region similar to the first and second dispensing regions, and (2) a pivotable third lid that is associated with the third dispensing region, and (3) protuberances for holding the third lid open.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 4 is a cross-sectional view taken generally along the plane 4—4 in FIG. 3;

FIG. 4A is a greatly enlarged, fragmentary view of the portion of the structure which is encircled in FIG. 4;

FIG. 5 is an exploded perspective view of the dispensing closure shown in FIG. 1, and FIG. 5 shows the top separated from the body;

FIG. 17 is an exploded perspective view of the second embodiment of the dispensing closure shown in FIG. 13, and FIG. 17 shows the top separated from the body;

FIG. 18 is a greatly enlarged, fragmentary view of a portion of the structure which is encircled in FIG. 13;

FIG. 19 is a perspective view of the underside of the closure body shown in FIG. 17;

FIG. 20 is a top plan view of the closure body shown in FIG. 17;

FIG. 21 is a cross-sectional view taken generally along the plane 21—21 in FIG. 20;

FIG. 22 is a cross-sectional view taken generally along the plane 22—22 in FIG. 20;

FIG. 23 is a perspective view of the underside of the closure top shown in FIG. 17;

FIG. 24 is a top plan view of the closure top shown in FIG. 17;

FIG. 25 is a cross-sectional view taken generally along the plane 25—25 in FIG. 24;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing system of this invention is described in a generally upright orientation that it could have at the upper end of a container when the container is stored upright on its base. It will be understood, however, that the dispensing system of this invention may be manufactured, stored, transported, used, and sold in orientations other than the position described.

The dispensing system of this invention is suitable for use with a variety of conventional or special containers having various designs, the details of which, although not illustrated or described, would be apparent to those having skill in the art and an understanding of such containers. With respect to the illustrated embodiments of the invention described herein, the container, per se, forms no part of, and therefore is not intended to limit, the broadest aspects of the present invention. It will also be understood by those of ordinary skill that novel and non-obvious inventive aspects are embodied in the described exemplary dispensing system alone.

Figure 1:
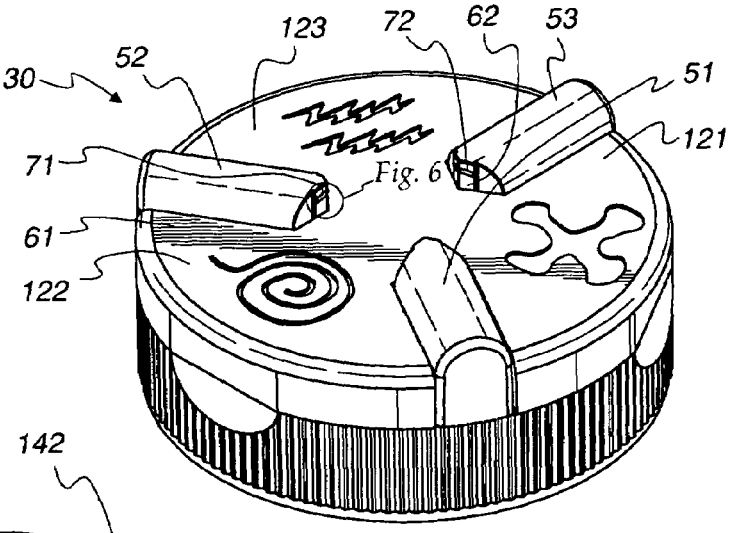
FIG. 1 is a perspective view of a first embodiment of a dispensing closure system of the present invention as embodied in a dispensing closure for use on, or as part of, a container (not illustrated), and the dispensing closure is shown in a normally closed orientation.

One presently preferred first embodiment of a dispensing closure system of the present invention is in the form of a dispensing closure assembly illustrated in FIGS. 1–12 and is designated generally therein by reference number 30 in FIG. 1. The dispensing closure assembly 30, which is hereinafter sometimes referred to more simply as the "closure 30," is provided as a separately manufactured unit or subassembly for mounting to the top of a container (not shown). It will be appreciated, however, that in some applications it may be desirable for the dispensing closure 30 to be formed as a unitary part, or extension, of the container wherein the unitary part or extension defines a dispensing end structure of the container, per se.

The container (not shown) typically has a conventional mouth which provides access to the container interior and product contained therein. The product may be, for example, a fluid or spreadable comestible product, such as mustard, ketchup, mayonnaise, etc. The product could also be any other fluent or spreadable material, including, but not limited to, powders, creams, lotions, slurries, pastes, etc. Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container typically may have a neck or other suitable structure defining the container mouth. The neck may have (but need not have) a circular cross-sectional configuration, and the body of the container may have another cross-sectional configuration, such as an oval cross-sectional shape, for example. The container may, on the other hand, have a substantially uniform shape along its entire length or height without any neck portion of reduced size or different cross-section.

The container typically may be a squeezable container having a flexible wall or walls which can be grasped by the user and compressed to increase the internal pressure within the container so as to squeeze the product out of the container through the closure 30 when the closure 30 is open. Such a container wall typically has sufficient, inherent resiliency so that when the squeezing forces are removed, the container wall tends to return to its normal, unstressed shape, and tends to draw ambient atmosphere into the container through the closure to the extent that the closure is an open mode or in-venting mode. Such a squeezable container structure is preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the product under the influence of gravity acting on the mass of the discharging product and/or under the influence of a reduced ambient pressure at the exterior of the container (e.g., as created by sucking on the open closure 30).

As shown in FIG. 5 for the first embodiment, the preferred multi-piece structure of the closure 30 comprises a base or body 32 and a top 34.

In the preferred, first embodiment illustrated in FIGS. 1–12, the closure body 32 and top 34 are preferably molded from a suitable thermoplastic material such as polypropylene or the like. Other materials may be employed instead.

In other contemplated embodiments, the closure 30 need not be a multi-piece structure comprising the body 32, per se, and top 34, per se. Further, the closure 30 need not be a structure that is completely separate from the container. Instead, the container, per se, could be made with a dispensing end structure that incorporates the body 32 as a unitary part of the container, or that incorporates both the body 32 and top 34 together as a unitary part of the container. In all of these alternatives, the body 32 may be characterized as a structural feature that functions to accommodate communication with the container interior.

In any of the above-discussed alternatives, the container may have a bottom end (i.e., the end opposite the dispensing end on which the closure 30 is located), and that container bottom end could be initially left open for accommodating the filling of the container with the product to be dispensed. After the container is filled with the product through the open bottom end of the container, the open bottom end of the container could be closed by suitable means, such as by a separate bottom end closure which could be attached to the container bottom end through a suitable threaded engagement, snap-fit engagement, adhesive engagement, thermal bonding engagement, etc. Alternatively, such an open bottom portion of the container could be deformed closed (e.g., with an appropriate process applying heat and force if the container bottom portion is made from a thermoplastic material or other material that would accommodate the use of such a process).

The body 32 may have a skirt 36 (FIGS. 7 and 9) with a conventional internal thread 38 for engaging a mating container thread (not shown) to secure the closure body 32 to the container (not shown).

The closure body 32 and container could also be releasably connected with a snap-fit bead and groove (not shown), or by other means. Alternatively, the closure body 32 may be permanently attached to the container by means of induction bonding, ultrasonic bonding, gluing, or the like, depending upon the materials employed for the container and closure body 32. The interior of the body 32 may include special or conventional seal features to provide an enhanced leak-tight seal between the closure body 32 and the container.

Figure 8:
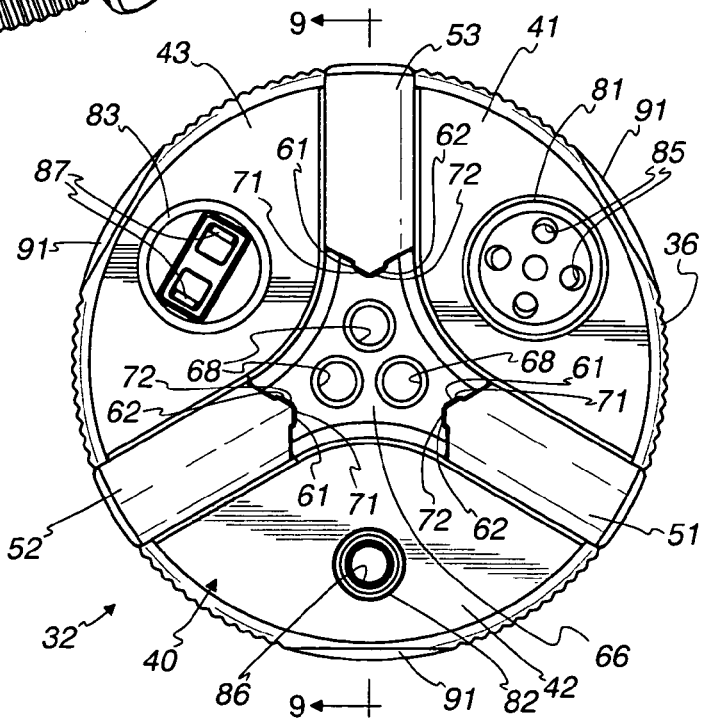
FIG. 8 is a top plan view of the closure body shown in FIG. 5.

The illustrated preferred, first form of the closure body 32 defines a radially inwardly extending deck 40 (FIG. 5). With reference to FIG. 8, the body deck 40 has a first deck portion 41, a second deck portion 42, and a third deck portion 43. The deck 40 also includes a radially oriented, upwardly projecting first wall 51 located between the deck first portion 41 and the deck second portion 42. The deck 40 also includes a radially oriented, upwardly projecting second wall 52 located between the deck second portion 42 and the deck third portion 43. The deck 40 also includes a radially oriented, upwardly projecting third wall 53 located between the deck third portion 43 and the deck first portion 41.

Figure 9:
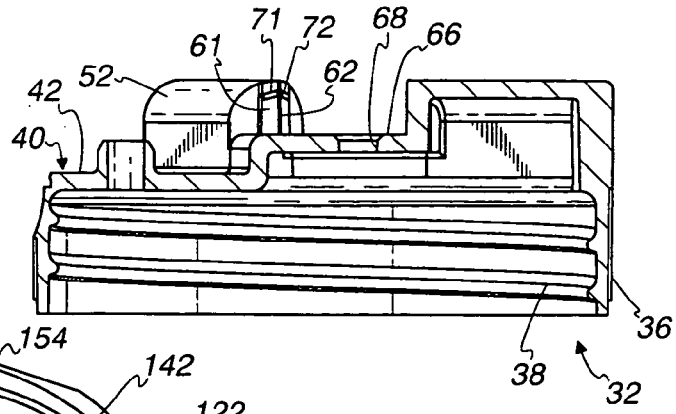
FIG. 9 is a cross-sectional view taken generally along the plane 9—9 in FIG. 8.

As can be seen in FIGS. 8 and 9, each wall 51, 52, and 53 has two inner end faces 61 and 62 which diverge away from each other. The wall inner end faces 61 and 62 extend generally vertically upwardly adjacent a raised central platform 66 (FIG. 5) that is higher than the first deck portion 41, second deck portion 42, and third deck portion 43. The raised central platform 66 extends radially inwardly from the inner end faces 61 and 62 of each wall 51, 52, and 53. The raised central platform 66 defines at least one anchor hole, and preferably three such anchor holes 68 (FIGS. 8 and 9).

Figure 6:
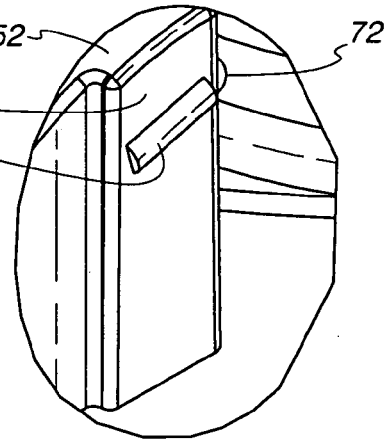
FIG. 6 is a greatly enlarged, fragmentary view of a portion of the structure which is encircled in FIG. 1.

As can be seen in FIGS. 1 and 6, the inner end face 61 of each first wall 51, second wall 52, and third wall 53 supports a protuberance 71 which projects laterally over the raised central platform 66 (see FIGS. 5 and 9). The inner end face 62 of each first wall 51, second wall 52, and third wall 53 supports a protuberance 72 which projects laterally over the raised central platform 66. As can be seen in FIG. 6, each protuberance 71 and 72 is elongate and has two ends. As can be seen with respect to protuberance 71 in FIG. 9, each protuberance is preferably oriented at a slight angle oblique to the closure body deck 40 and to the common plane that contains the pivot axes of the three lid hinges.

The deck first portion 41, deck second portion 42, and deck third portion 43, each have a dispensing region in the shape of a cylindrical protuberance or spout 81, 82, and 83, respectively (as can be seen in FIGS. 5 an 8). As can be seen in FIG. 8, the first dispensing region or spout 81 has five cylindrical dispensing apertures 85, the second dispensing region or spout 82 has a single cylindrical dispensing aperture 86, and the third dispensing region or spout 83 has a pair of dispensing apertures 87 which each has the shape of a square conduit opening. The central aperture 85 has a longitudinal axis parallel to the main longitudinal axis of the closure. The remaining four apertures 85 each have a longitudinal axis that is at an oblique angle relative to the axis of the central aperture 85 as can be seen in FIG. 8, and this gives a wider dispersion discharge pattern. Apertures 85, 86 and 87 may have other shapes where desired depending upon the particular application.

As can be seen in FIG. 8, the exterior surface of the skirt 36 of the closure body 32 has three circumferentially spaced thumb access recesses 91, the shape of which is apparent from the perspective view of the closure body 32 in FIG. 5. The major portion of the remaining exterior surface of the closure body skirt 36 is preferably formed with a circumferential array of axially extending ribs or grooves to provide an enhanced gripping surface for the user.

FIG. 4A and FIGS. 10–12 illustrate in more detail the structure of the top 34. With reference to the underside view of the top 34 in FIG. 9, the top 34 includes a stationary central panel 100. Three anchor posts 102 project from beneath the central panel 100. Each anchor post 102 has an enlarged head which is temporarily elastically deformable for initially deforming to pass through one of the closure body central platform anchor holes 68 and for subsequently returning to its undeformed configuration beneath the platform 66 to create a snap-fit engagement mounting of the top central panel 100 to the closure body platform 66 as can be seen in FIG. 4.

Figure 10:
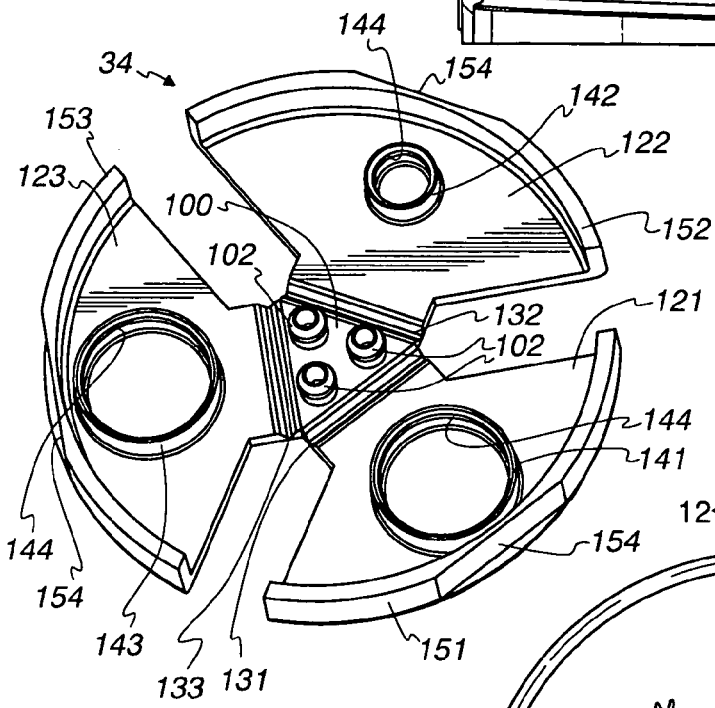
FIG. 10 is a perspective view of the underside of the closure top shown in FIG. 5.
Figure 11:
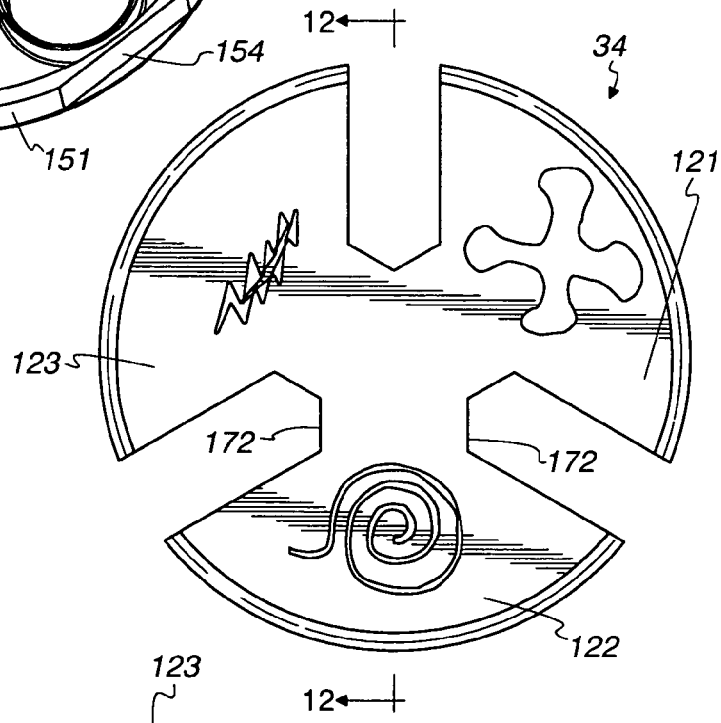
FIG. 11 is a top plan view of the closure top shown in FIG. 5.
Figure 12:
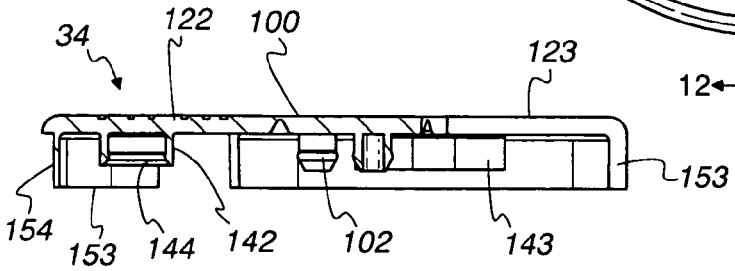
FIG. 12 is a cross-sectional view taken generally along the plane 12—12 in FIG. 11.

As can be seen in FIG. 10, the lid 34 has a first lid 121, a second lid 122, and a third lid 123. As can be see in FIG. 5, the first lid 121 is associated with, and adapted to overlie, the deck first portion 41. The second lid 122 is associated with, and adapted to overlie, the deck second portion 42. The third lid 123 is associated with, and adapted to overlie, the deck third portion 43.

As can be seen in FIG. 10, the first lid 121 is connected to the central panel 100 with a first film hinge 131. The second lid 122 is connected to the central panel 100 with a second film hinge 132. The third lid 123 is connected to the central panel 100 with a third film hinge 133. Each film hinge 131, 132, and 133 is defined by a generally V-shaped groove in the underside of the top 34 so as to define a reduced thickness portion of material which accommodates selective movement of the connected lid between a closed position (as shown in FIGS. 1 and 4) and a full open position (as shown for the second lid 122 in FIG. 2).

As can be seen in FIG. 10, the underside of the first lid 121 has a projecting cylindrical sealing collar 141. The underside of the second lid 122 has a projecting sealing collar 142. The underside of the third lid 123 has a projecting cylindrical sealing collar 143. Each sealing collar 141, 142, and 143 has an inwardly projecting annular seal bead 144 for sealingly engaging the exterior cylindrical surface of the associated closure body spout (e.g., spout 81, 82, or 83 visible in FIG. 5). FIG. 4A shows the second lid 122 closed with the sealing collar 142 surrounding the closure body spout 82 and with the annular bead 144 on the sealing collar 142 sealingly engaging the exterior cylindrical surface of the closure body spout 82.

As can be seen in FIG. 10, the first lid 121 includes a front skirt 151, the second lid 122 includes a front skirt 152, and the third lid 123 includes a front skirt 153. The exterior of each skirt 151, 152, and 153 defines a recessed thumb lift 154. As can be seen in FIG. 10, each thumb lift 154 defines an undercut region of the lid against which a thumb or finger can be pushed to open the lid.

The interior of each lid skirt 151, 152 and 153 includes a laterally or radially inwardly projecting latch bead, and FIG. 4A shows such a latch bead 162 on the second lid skirt 152. The deck second portion 42 includes a laterally or radially outwardly extending latch bead 164 for cooperating with the second lid latch bead 162. As can be seen in FIG. 4, when the second lid 122 is closed, the second lid latch bead 162 is spaced slightly below the closure body deck second portion latch bead 164. If the second lid 122 is subjected to an upwardly directed force (e.g., from an unintentional impact or from an intentional push by a user's finger or thumb), then the second lid 122 may move slightly upwardly until the latch beads 162 and 164 engage. At this point, substantially greater force is required to move the lid latch bead 162 past and over the closure body latch bead 164. This arrangement of the latch beads 162 and 164 functions to hold the lid in the closed position during normal handling of the closure 30 and associated package. However, the latch bead arrangement accommodates deliberate opening of the lid 122 when a sufficient opening force is applied. Further, when the lid is closed, the arrangement of the spaced-apart latch beads 162 and 164 accommodates slight variations in vertical dimensions owing to manufacturing tolerances.

Figure 2:
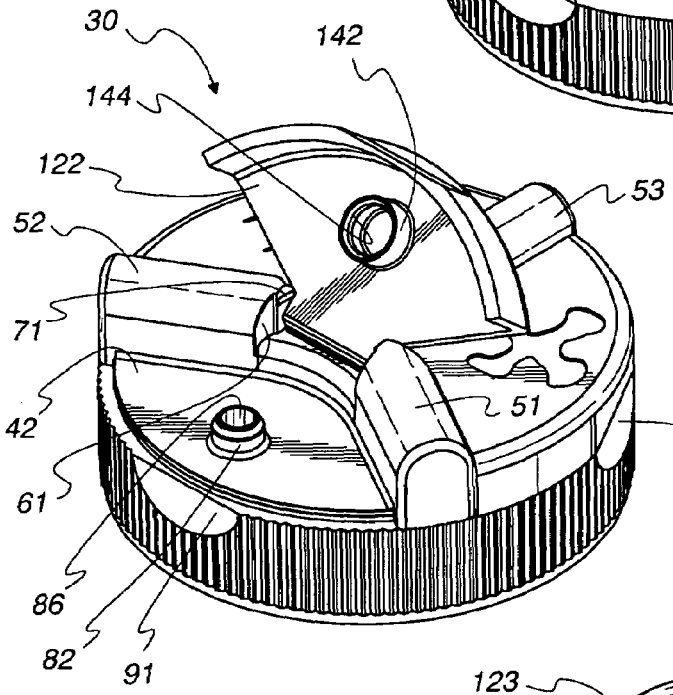
FIG. 2 is a view similar to FIG. 1, but FIG. 2 shows one of three lids on the dispensing closure top moved to a latched open position.

As can be seen in FIG. 2, the second lid 122 can be pushed upwardly and pivoted about its hinge to an open position. The second lid 122 can be retained or maintained in that open position by engagement with the closure body protuberances on the first wall 51 and second wall 52. With reference to FIGS. 1 and 4, the protuberance 71 on the inner end face 61 of the second wall 52 is adapted to engage a lateral portion of the second lid 122 as the second lid 122 is moved to the open position. Similarly, with reference to FIG. 3, the protuberance 72 on the inner end face 62 of the first wall 51 is adapted to engage the other lateral edge portion of the second lid 122. In particular, with reference to FIG. 11, it can be seen that the second lid 122 has a reduced width region defining a pair of lateral edges or margins 172 for engaging and being forced past one of the closure body protuberances (e.g., 71 or 72) as the second lid 122 is pivoted to the fully open position where the second lid 122 is retained. Also, some additional resistance to the pivoting of the lid is created by a slight interference between the lateral sides or margins 172 of the lid and the adjacent inner end faces 61 and 62 of the walls 52 and 51, respectively.

The second lid 122 is retained in the fully open position (FIG. 2) unless a closing force is applied to the second lid 122 so as to move the second lid 122 toward the closed position and force the second lid margins 172 past the protuberances 71 and 72. When the second lid 122 is fully open, it is preferably retained at an angle of about 170 degrees or more from the closed position. This exposes the area around the dispensing aperture 82 and provides a clearance around the deck second portion 42. When the second lid 122 is held in the fully open position, the user can readily dispense the product without the second lid 122 significantly blocking the view of the discharging stream of the fluent product and without the second lid 122 hanging down in a way that might inadvertently touch the target area such as a plate of food or the like.

When the second lid 122 is in the fully opened position as illustrated in FIG. 2, the underside edges of the lid lateral margins near the wall 51 or 52 are preferably located beneath the retention protuberances (protuberance 71 on one side of the lid 122 and protuberance 72 on the other side of the lid 122).

The other two lids, the first lid 121 and the third lid 123, function in the same manner as the second lid 122 described above. Thus, the user may selectively open any one of the three lids, and that opened lid can be retained in the fully opened position during the dispensing process or during cleaning of the deck portion surrounding the dispensing aperture.

Figure 3:
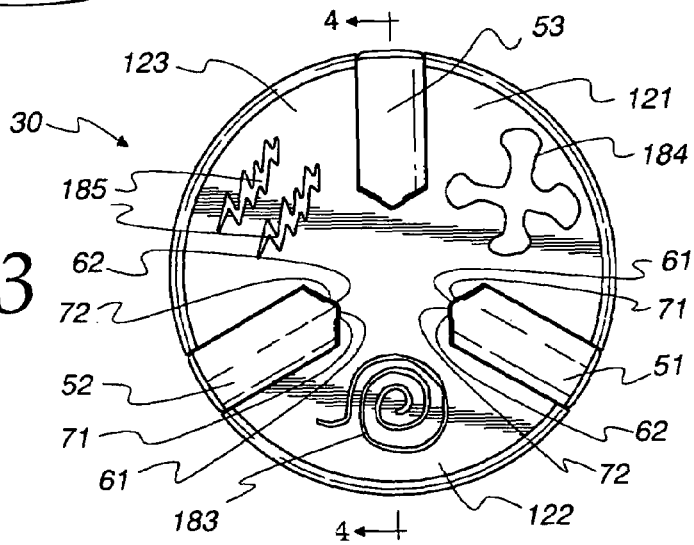
FIG. 3 is a top plan view of the dispensing closure shown in FIG. 1.

When the second lid 122 is opened to dispense fluent product (such as mustard) through the dispensing aperture 86, a relatively small, generally cylindrical stream is discharged. During dispensing, the user can move the closure (with the attached container) so as to dispense and deposit the stream in a desired pattern, such as a spiral pattern. To that end, the exterior upper surface of the second lid 122 includes the design configuration of a spiral 183 as illustrated in FIG. 3. This serves as an example of one of various shapes in which the fluent product could be deposited by the user.

The first lid 121 can be opened to expose the five dispensing apertures 85 (FIG. 5). The product discharging through the five apertures 85 may form an initial deposit in the shape of a cross or plus sign. To that end, a design of a cross or plus sign 184 is displayed on the exterior upper surface of the first lid 121.

The two dispensing apertures 87 (FIG. 5) can dispense two parallel streams of fluent product simultaneously. If the user moves the package in a zig-zag manner during dispensing, then the fluent material will be deposited in two zig-zag configurations. To this end, the exterior upper surface of the third lid 123 is provided with the design of two zig-zag shapes 185 (FIG. 3).

The closure 30 can be readily molded in two parts—the closure body 32 and the closure top 34. The two parts can then be easily assembled by snap-fitting the closure top 34 onto the closure body 32. The two parts can be made in different colors and/or from different materials.

A presently preferred second embodiment of a dispensing system of the present invention, in the form of a dispensing closure assembly, is illustrated in FIGS. 13–25. As shown in FIG. 17 for the second embodiment, the preferred multi-piece structure of the closure 30A comprises a base or body 32A and a top 34A. The closure body 32A and top 34A are preferably molded from a suitable thermoplastic material such as polypropylene or the like. Other materials may be employed instead. As with the first embodiment closure 30 discussed above, the second embodiment closure 30A need not be a multi-piece structure and need not be a structure that is completely separate from the container. Instead, the container, per se, could be made with a dispensing end structure that incorporates the body 32A as a unitary part of the container, or that incorporates both the body 32A and top 34A together as a unitary part of the container.

The body 32A may have a skirt 36A (FIGS. 19 and 22) with a conventional internal thread 38A for engaging a mating container thread (not shown) to secure the closure body 32A to the container (not shown).

The closure body 32A and container could also be releasably connected with a snap-fit bead and groove (not shown), or by other means. Alternatively, the closure body 32A may be permanently attached to the container by means of induction bonding, ultrasonic bonding, gluing, or the like, depending upon the materials employed for the container and closure body 32A. The interior of the body 32A may include special or conventional seal features to provide an enhanced leak-tight seal between the closure body 32A and the container.

The illustrated second form of the closure body 32A defines a radially inwardly extending deck 40A (FIG. 17). With reference to FIG. 17, the body deck 40A has a first deck portion 41A and a second deck portion 42A. The deck 40A also includes an upwardly projecting first wall 51A located along one side of the deck first portion 41A and the deck second portion 42A. The deck 40A also includes an upwardly projecting second wall 52A spaced from, and parallel to, the first wall 51A. The second wall 52A is located along one side of the deck second portion 42A and the deck first portion 41A.

As can be seen in FIGS. 17 and 22, each wall 51A and 52A has a projecting inner face 61A and 62A, respectively. The wall inner faces 61A and 62A extend generally vertically upwardly adjacent a raised central platform 66A (FIGS. 17 and 22) that is higher than the first deck portion 41A and second deck portion 42A. The raised central platform 66A extends between the inner faces 61A and 62A. The raised central platform 66 defines at least one anchor hole, and preferably two such anchor holes 68A (FIGS. 17 and 22).

As can be seen in FIGS. 17 and 22, the inner face 61A supports a protuberance 71A which projects laterally over the raised central platform 66A. The inner face 62A of the second wall 52A supports a protuberance 72A which projects laterally over the raised central platform 66A. As can be seen in FIG. 18, the protuberance 71A is elongate and has two ends 73A and 75A which are each rounded and define camming surfaces. The protuberance 72A has an identical shape. As can be seen with respect to protuberance 71A in FIGS. 18 and 21, each protuberance has a rounded lower edge that curves upwardly slightly toward each end 73A and 75A from a low point in the middle.

The deck first portion 41A and deck second portion 42A each have a dispensing region in the shape of a cylindrical protuberance or spout 81A and 82A, respectively (as can be seen in FIGS. 17 an 20). As can be seen in FIG. 20, the first dispensing region or spout 81A has a pair of dispensing apertures 85A which each has the shape of a square conduit opening, and the second dispensing region or spout 82A has eight cylindrical dispensing apertures 88A.

Figure 13:
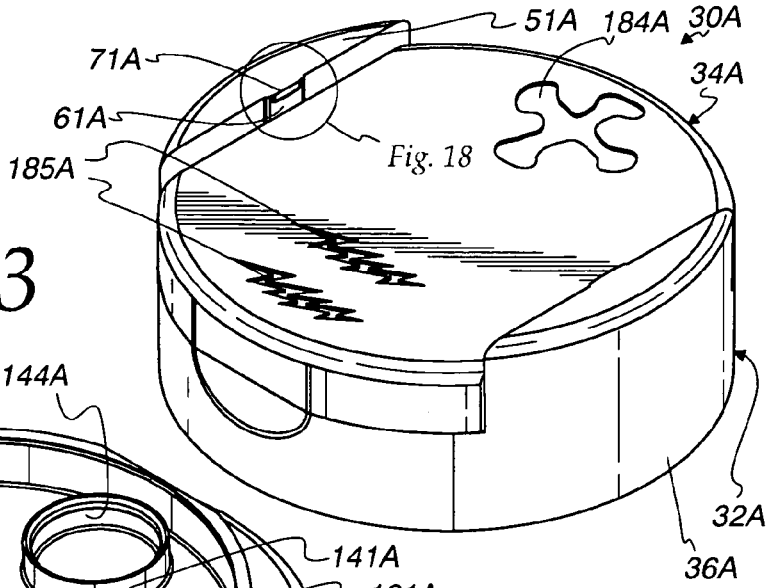
FIG. 13 is a perspective view of a second embodiment of a dispensing closure system of the present invention as embodied in a dispensing closure for use on, or as part of, a container (not illustrated), and the dispensing closure is shown in a normally closed orientation.
Figure 16:
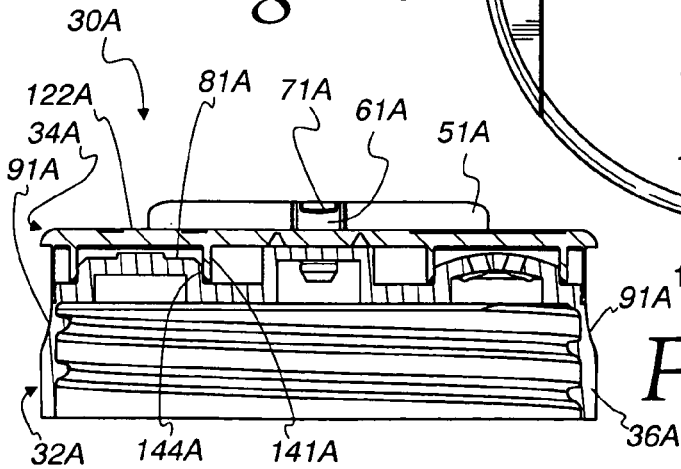
FIG. 16 is a cross-sectional view taken generally along the plane 16—16 in FIG. 15.

As can be seen in FIGS. 13 and 16, the exterior surface of the skirt 36A of the closure body 32A has two circumferentially spaced thumb access recesses 91A, the shape of which is apparent from the perspective view of the closure body 32A in FIG. 17. The major portion of the remaining exterior surface of the closure body skirt 36 is smooth, but may instead be formed with a circumferential array of axially extending ribs or grooves to provide an enhanced gripping surface for the user (as in the first embodiment illustrated in FIG. 1).

FIG. 17 and FIGS. 23–25 illustrate in more detail the structure of the top 34A. With reference to the underside view of the top 34A in FIG. 23, the top 34A includes a stationary central panel 100A. Two anchor posts 102A project from beneath the central panel 100A. Each anchor post 102A has an enlarged head which is temporarily elastically deformable for initially deforming to pass through one of the closure body central platform anchor holes 68A and for subsequently returning to its undeformed configuration beneath the platform 66A to create a snap-fit engagement mounting of the top central panel 100A to the closure body platform 66A as can be seen in FIG. 16.

As can be seen in FIG. 23, the lid 34A has a first lid 121A and a second lid 122A. As can be see in FIG. 17, the first lid 121A is associated with, and adapted to overlie, the deck first portion 41A. The second lid 122A is associated with, and adapted to overlie, the deck second portion 42A.

As can be seen in FIG. 23, the first lid 121A is connected to the central panel 100A with a first film hinge 131A. The second lid 122A is connected to the central panel 100A with a second film hinge 132A. Each film hinge 131A and 132A is defined by a generally V-shaped groove in the underside of the top 34A so as to define a reduced thickness portion of material which accommodates selective movement of the connected lid between a closed position (as shown in FIGS. 13 and 16) and a full open position (as shown for the second lid 122A in FIG. 14).

As can be seen in FIG. 23, the underside of the first lid 121A has a projecting cylindrical sealing collar 141A. The underside of the second lid 122A has a projecting sealing collar 142A. Each sealing collar 141A and 142A has an inwardly projecting annular seal bead 144A for sealingly engaging the exterior cylindrical surface of the associated closure body spout (e.g., spout 81A and spout 82A visible in FIG. 17). FIG. 16 shows the first lid 121A closed with the sealing collar 141A surrounding the closure body spout 81A and with the annular bead 144A on the inside of the sealing collar 142A sealingly engaging the exterior cylindrical surface of the closure body spout 81A.

As can be seen in FIG. 23, the first lid 121A includes a front skirt 151A, and the second lid 122A includes a front skirt 152A. The exterior of each skirt 151A and 152A defines a recessed thumb lift 154A. As can be seen in FIG. 23, each thumb lift 154A defines an undercut region of the lid against which a thumb or finger can be pushed to open the lid.

The interior of each lid skirt 151A and 152A includes a laterally or radially inwardly projecting latch bead 161A and 162A, respectively (FIG. 25). As can be seen in FIG. 21, the deck first portion 41A and deck second portion 42A each include a laterally or radially outwardly extending latch bead 164A and 165A, respectively, for cooperating with the first and second lid latch beads 161A and 162A, respectively. When either lid is closed, the lid latch bead is spaced slightly below the adjacent closure body deck portion latch bead in the same manner as described above in detail with respect to the first embodiment latch beads 162 and 164 illustrated in FIG. 4A. If the lid is subjected to an upwardly directed force (e.g., from an unintentional impact or from an intentional push by a user's finger or thumb), then the lid may move slightly upwardly until the lid and body latch beads engage. At this point, substantially greater force is required to move the lid latch bead past and over the closure body latch bead. This arrangement of the latch beads functions to hold the lid in the closed position during normal handling of the closure 30A and associated package. However, the latch bead arrangement accommodates deliberate opening of the lid when a sufficient opening force is applied. Further, when the lid is closed, the arrangement of the spaced-apart latch beads accommodates slight variations in vertical dimensions owing to manufacturing tolerances.

Figure 14:
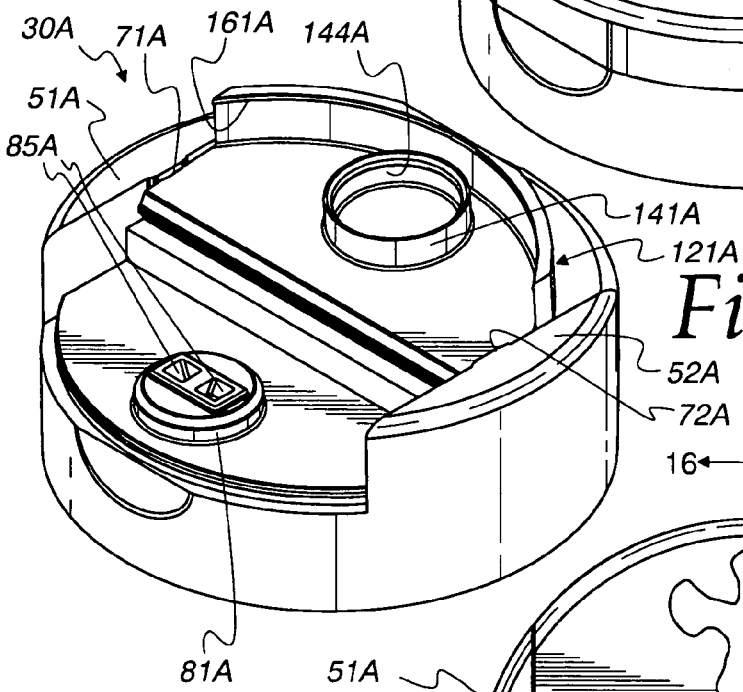
FIG. 14 is a view similar to FIG. 13, but FIG. 14 shows one of two lids on the dispensing closure top moved to a latched open position.
Figure 15:
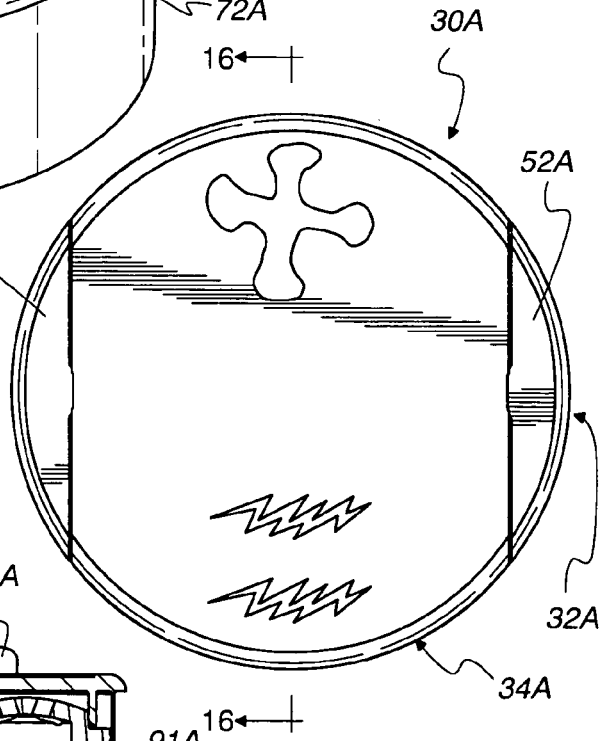
FIG. 15 is a top plan view of the second embodiment closure illustrated in FIG. 13.

As can be seen in FIG. 14, the first lid 121A can be pushed upwardly and pivoted about its hinge to an open position. The first lid 121A can be retained or maintained in that open position by engagement with the closure body protuberance 71A on the first wall 51A and the closure body protuberance 72A on the second wall 52A. With reference to FIGS. 13 and 16, the protuberance 71A on the inner face 61A of the first wall 51A is adapted to engage a lateral portion of the first lid 121A as the first lid 121A is moved to the open position. Similarly, with reference to FIG. 22, the protuberance 72A on the inner face 62A of the second wall 52A is adapted to engage the other lateral edge portion of the first lid 121A. The first lid 121 may thus be characterized as defining a pair of lateral edges or margins 171A (FIG. 23) for each engaging and being forced past one of the closure body protuberances (e.g., 71A or 72A) as the first lid 121A is pivoted to the fully open position where the first lid 121A is retained.

The first lid 121A is retained in the fully open position (FIG. 14) unless a closing force is applied to the first lid 121A so as to move the first lid 121A toward the closed position and force the first lid margins 171A past the protuberances 71A and 72A. When the first lid 121A is fully open, it is preferably retained at an angle of about 170 degrees or more from the closed position. This exposes the area around the dispensing aperture 81A and provides a clearance around the deck second portion 41A. When the first lid 121A is held in the fully open position, the user can readily dispense the product without the first lid 121A significantly blocking the view of the discharging stream of the fluent product and without the first lid 121A hanging down in a way that might inadvertently touch the target area—such as a plate of food or the like.

When the first lid 121A is in the fully opened position as illustrated in FIG. 14, the underside edges of the lid lateral margins 171A near the wall 51A or wall 52A are preferably located beneath the retention protuberances (protuberance 71A on one side of the lid 121A and protuberance 72A on the other side of the lid 121A).

The second lid 122A functions in the same manner as the first lid 121A described above. Thus, the user may selectively open either one of the two lids, and that opened lid can be retained in the fully opened position during the dispensing process or during cleaning of the deck portion surrounding the dispensing aperture.

The second lid 122A can be opened to expose the eight dispensing apertures 88A (FIG. 20). The product discharging through the eight apertures 88A may form an initial deposit in the shape of a cross or plus sign. To that end, a design of a cross or plus sign 184A (FIG. 13) is displayed on the exterior upper surface of the second lid 122A.

The first lid 121A can be opened to expose the two dispensing apertures 85A. The two dispensing apertures 85A (FIGS. 14 and 20) can dispense two parallel streams of fluent product simultaneously. If the user moves the package in a zig-zag manner during dispensing, then the fluent material will be deposited in two zig-zag configurations. To this end, the exterior upper surface of the first lid 121A is provided with the design of two zig-zag shapes 185A (FIG. 13).

The closure 30A can be readily molded in two parts—the closure body 32A and the closure top 34A. The two parts can then be easily assembled by snap-fitting the closure top 34A onto the closure body 32A. The two parts can be made in different colors and/or from different materials.

In both the first embodiment of the dispensing system illustrated in FIGS. 1–12 and in the second embodiment of the dispensing system illustrated in FIGS. 13–25, the top structure is separate from the closure body. In some applications, it may be desirable to form the closure top and the closure body as a one-piece, unitary structure. However, in the illustrated embodiments, where the top is separate from the body, other forms or arrangements of attaching the top to the body may be employed.

FIGS. 26–31 illustrate a presently preferred, alternative arrangement for attaching a separate closure top to the closure body. The alternative arrangement illustrated in FIGS. 26–31 is shown as incorporated in the three-lid structure of the kind described above with reference to the first embodiment illustrated in FIGS. 1–12. In the first embodiment illustrated in FIGS. 1–12, the top is mounted to the closure body with three anchor posts 102 which are received in anchor holes 68. However, in the alternative arrangement of anchoring the top to the body as illustrated in FIGS. 26–31, only one anchor post is employed as explained in detail hereinafter. It will be appreciated that such an alternate form of anchoring a separate top to a separate closure body with one anchor post may also be employed in the second embodiment of the closure illustrated in FIGS. 13–25.

With reference to FIGS. 26–31, the alternate form of the closure body is designated by the reference number 32B, and the alternate form of the closure top is designated by the reference number 34B. Many of the basic features of the alternate form of the closure body 32B and closure top 34B are identical to features previously described for the first embodiment of the closure body 32 and closure top 34. The features of the alternate forms of the closure body 32B and top 34B which are identical to the first embodiment features need not be described herein again in detail.

Figure 7:
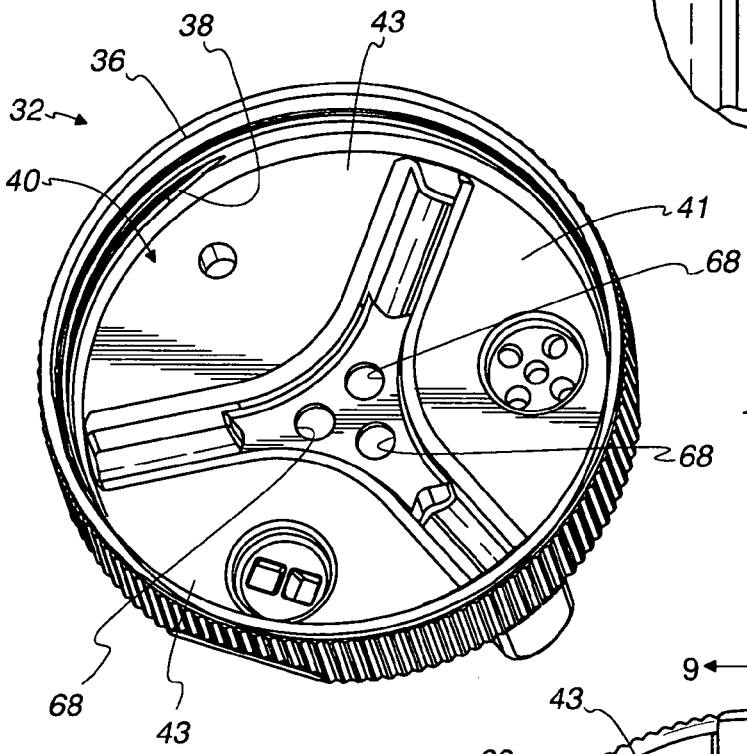
FIG. 7 is a perspective view of the underside of the closure body shown in FIG. 5.
Figure 26:
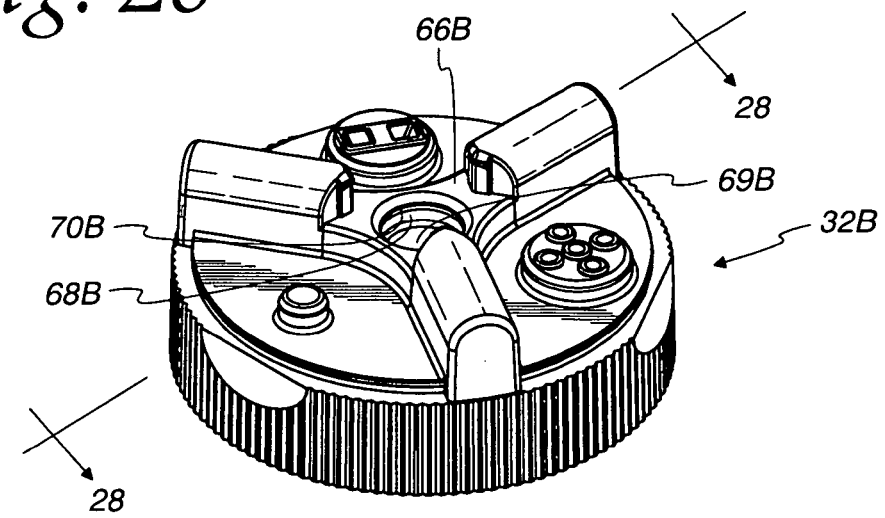
FIG. 26 is a perspective view of an alternate form of the closure body illustrated in FIG. 5.
Figure 27:
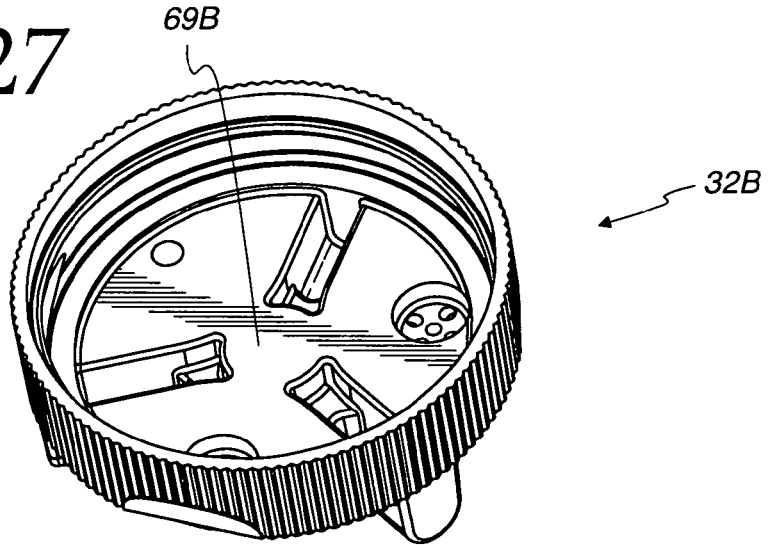
FIG. 27 is a perspective view of the underside of the alternate form of the closure body shown in FIG. 26.
Figure 28:
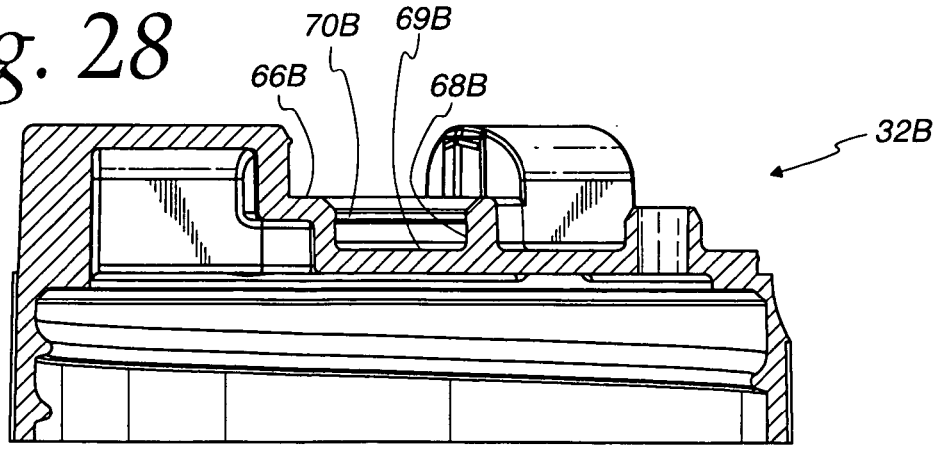
FIG. 28 is an enlarged cross-sectional view taken generally along the plane 28—28 in FIG. 26.

The alternate form of the closure body 32B as illustrated in FIGS. 26–28 includes a single anchor recess 68B in a raised, central platform 66B. The single anchor recess 68B is generally functionally analogous to the three anchor holes 68 employed in the first embodiment of the closure body 32 as illustrated in FIGS. 4, 7, and 9. However, unlike the anchor holes 68, the single recess 68B does not extend completely through the raised cental platform 66B. The lower end of the recess 68B terminates in a flat bottom floor 69B (FIGS. 26 and 28). The recess 68B has a generally cylindrical configuration, and near the upper, open end of the recess 68B is an annular snap-fit bead 70B (FIGS. 26–28) which projects radially inwardly a small amount.

Figure 29:
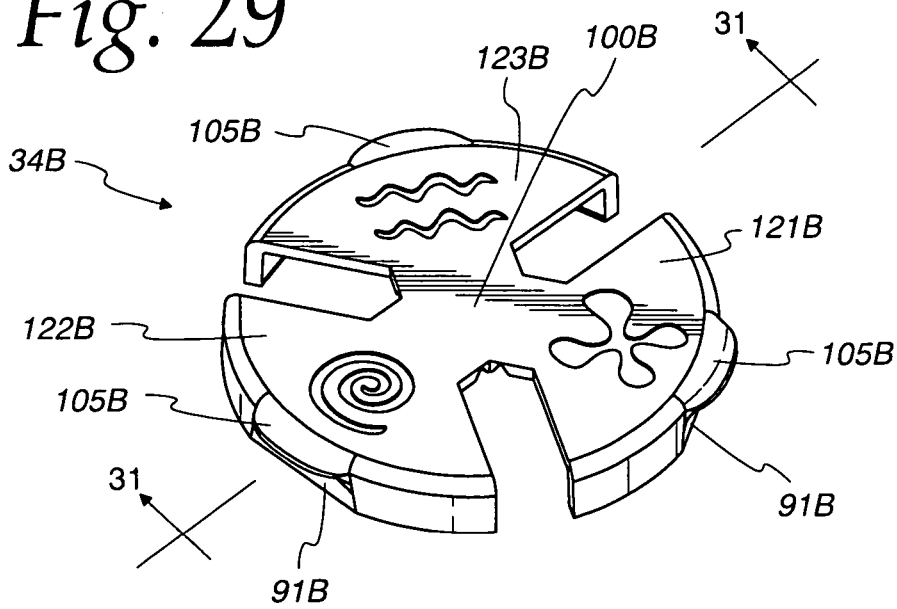
FIG. 29 is a perspective view of an alternate form of the closure top shown in FIG. 5.
Figure 30:
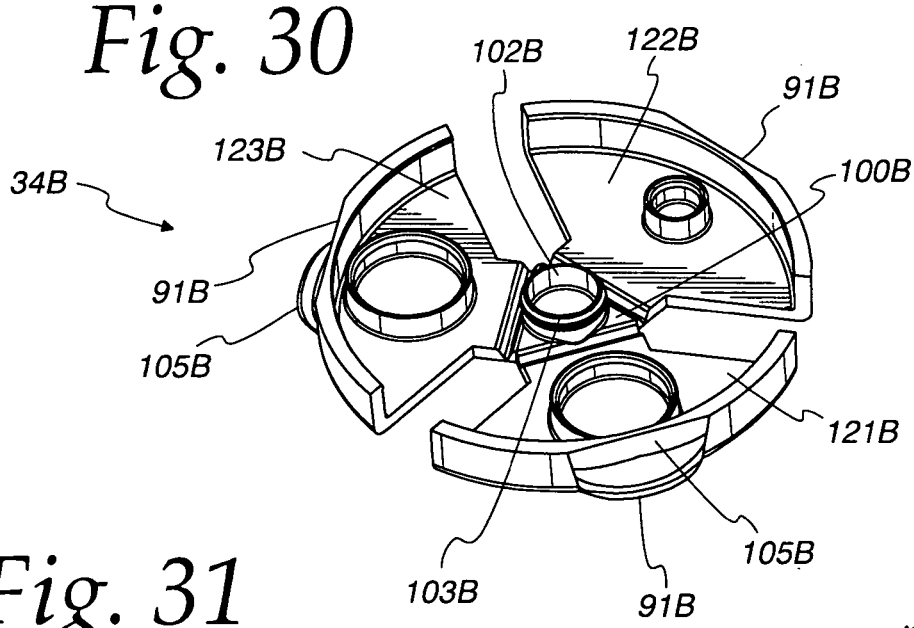
FIG. 30 is a perspective view of the underside of the alternate form of the closure top shown in FIG. 29.
Figure 31:
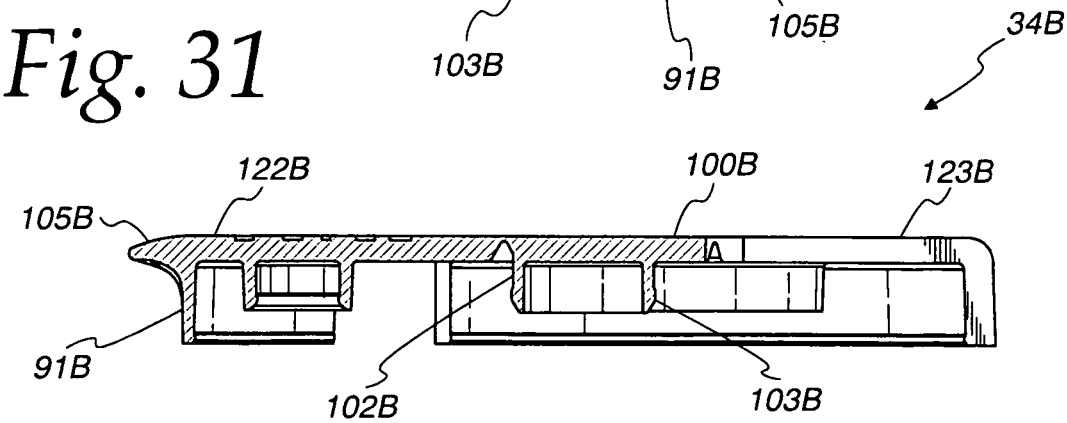
FIG. 31 is an enlarged, cross-sectional view taken generally along the plane 31—31 in FIG. 29.

The alternate embodiment of the closure top 34B illustrated in FIGS. 29–31 includes a stationary central panel 100B (FIGS. 29–31) to which is hingedly connected a first lid 121B, a second lid 122B, and a third lid 123B. One anchor post 102B projects downwardly from beneath the central panel 100B (FIGS. 30 and 31). The anchor post 102B has a generally hollow, cylindrical configuration with an external, annular, snap-fit bead 103B (FIGS. 30 and 31).

As can be seen in FIGS. 29–31, each lid 121B, 122B, and 123B includes an outwardly extending lift tab 105B which projects beyond a shallow thumb recess 91B.

The top 34B is mounted to the upper end of the closure body 32B in the same orientation as the first embodiment closure top 34 is mounted on the first embodiment closure body 32 as shown for the first embodiment in FIGS. 1–3. However, in the alternate embodiment shown in FIGS. 26–31, there is only a single anchor post 102B for being received in a single anchor recess 68B in a snap-fit engagement. In such a snap-fit engagement, the single anchor post annular bead 103B (FIG. 31) moves past and below the snap-fit bead 70B in the anchor recess 68B. As the top 34B is pushed down onto the closure body 32B to force the closure top anchor post bead 103B past the closure body anchor recess bead 70B, some amount of temporary, elastic deformation occurs in the bead and adjacent structure of the closure body 32B, or closure top 34B, or both.

After the closure top 34B has been properly mounted on the closure body 32B, the lids 121B, 122B, and 123B may be opened and closed (and may be retained in the opened and closed positions) in the same manner as described above with respect to the lids 121, 122, and 123 of the first embodiment illustrated in FIGS. 1–12.

The single anchor post/anchor recess construction described above with respect to the alternate embodiment illustrated in FIGS. 26–31 for the three-lid arrangement may also be employed in the two-lid arrangement illustrated in FIGS. 13–25. The two-lid arrangement illustrated in FIGS. 13–25 can be modified by changing the two anchor posts 102A (FIG. 23) to a single anchor post with an annular snap-fit bead, and by modifying the raised central platform 66A to be thicker and to define a single anchor recess with a closed bottom and an inwardly projecting annular snap-fit bead.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure system for a container that has an interior where a product may be stored, said dispensing closure system comprising:

(A) a body for accommodating communication with said container interior and including (1) a deck having (a) a deck first portion that includes a first dispensing region defining at least one aperture from which product can be dispensed, (b) a deck second portion that includes a second dispensing region defining at least one aperture from which product can be dispensed, and (c) a deck third portion that includes a third dispensing region defining at least one aperture from which product can be dispensed;

(2) radially oriented, upwardly projecting, first, second, and third walls wherein said first wall is located between said deck first portion and said deck second portion, wherein said second wall is located between said deck second portion and said deck third portion, and wherein said third wall is located between said deck third portion and said deck first portion; each said wall having two inner end faces that diverge from each other;

(3) a central raised platform that (a) is higher than said deck, first portion, second portion, and third portion, (b) extends radially inwardly from said inner end faces of each said wall, and (c) defines one anchor recess with a annular snap-fit retention bead;

(4) a protuberance projecting laterally from one of said two inner end faces of said first wall over said raised platform;

(5) a protuberance projecting laterally from the other one of said two inner end faces of said first wall over said raised platform;

(6) a protuberance projecting laterally from one of said two inner end faces of said second wall over said raised platform;

(7) a protuberance projecting laterally from the other one of said two inner end faces of said second wall over said raised platform;

(8) a protuberance projecting laterally from one of said two inner end faces of said third wall over said raised platform;

(9) a protuberance projecting laterally from the other one of said two inner end faces of said third wall over said raised platform;

(B) a top that is mounted to said body and that includes
(1) a stationery central panel,
(2) an anchor post that
(a) projects from beneath said central panel, and
(b) has an annular bead for cooperating with said anchor post retention bead to mount said central panel to said platform with a snap-fit engagement when said anchor post is inserted into said anchor recess,
(3) a first lid that
(a) is associated with said first dispensing region,
(b) is hingedly connected to said central panel,
(c) is pivotable between (i) a closed position occluding said first dispensing region aperture, and (ii) a fully open position away from said closed position to permit dispensing of product from the container through said first dispensing region aperture, and
(d) defines two lateral margins for each engaging and being forced past one of said protuberances as said first lid is pivoted to said fully open position where said first lid is retained unless a sufficient closing force is applied to said first lid so as to move said first lid toward said closed position and force said first lid margins past said protuberances;
(4) a second lid that
(a) is associated with said second dispensing region,
(b) is hingedly connected to said central panel,
(c) is pivotable between (i) a closed position occluding said second dispensing region aperture, and (ii) a fully open position away from said closed position to permit dispensing of product from the container through said second dispensing region aperture, and
(d) defines first and second lateral margins for each engaging and being forced past said first and second protuberance, respectively, as said second lid is pivoted to said fully open position where said second lid is retained unless a sufficient closing force is applied to said second lid so as to move said second lid toward said closed position and force said second lid margins past said protuberance;
(5) a third lid that
(a) is associated with said third dispensing region,
(b) is hingedly connected to said central panel,
(c) is pivotable between (i) a closed position occluding said third dispensing region aperture, and (ii) a fully open position away from said closed position to permit dispensing of product from the container through said third dispensing region aperture, and
(d) defines two lateral margins for each engaging and being forced past one said protuberances as said third lid is pivoted to said fully open position where said third lid is retained unless a sufficient closing force is applied to said third lid so as to move said third lid toward said closed position and force said third lid margins past said protuberances.

2. The system in accordance with claim 1 which
a first hinge connects said first lid to said central panel,
a second hinge connects said second lid to said central panel,
a third hinge connects said third lid to said central panel,
said hinges each defines a pivot axis,
said pivot axes of the hinges lie in, and define, a common plane, and
each said protuberance has an elongate configuration oriented at an oblique angle with respect to said common plane.

3. The system in accordance with claim 1 in which each said protuberance (A) is elongate, and (B) has at least one end for initially engaging one of said lateral margins of one of said lids.

4. A dispensing closure system for a container that has an interior where a product may be stored, said dispensing closure system comprising:
(A) a body for accommodating communication with said container interior and including
(1) a deck having at least (a) a first dispensing region defining at least one aperture from which product can be dispensed, and (b) a second dispensing region defining at least one aperture from which product can be dispensed, and
(2) at least two spaced-apart protuberances that each (a) are located higher than the elevation of said deck, and (b) project laterally toward each other;
(B) at least a first lid that
(1) is associated with said first dispensing region,
(2) is pivotable between (a) a closed position occluding said first dispensing region aperture, and (b) a fully open position away from said closed position to permit dispensing of product from the container through said first dispensing region aperture, and
(3) defines two lateral margins for each engaging and being forced past one said protuberances as said first lid is pivoted to said fully open position where said first lid is retained unless a sufficient closing force is applied to said first lid so as to move said first lid toward said closed position and force said first lid margins past said protuberances;
(C) at least a second lid that
(1) is associated with said second dispensing region,
(2) is pivotable between (a) a closed position occluding said second dispensing region aperture, and (b) a fully open position away from said closed position to permit dispensing of product from the container through said second dispensing region aperture, and
(3) defines two lateral margins for each engaging and being forced past one said protuberances as said second lid is pivoted to said fully open position where said second lid is retained unless a sufficient closing force is applied to said second lid so as to move said second lid toward said closed position and force said second lid margins past said protuberances.

5. The system in accordance with claim 4 in which said system is a dispensing closure for a container that has an opening to the container interior, said closure being separate from, but releasably attachable to, said container around said opening.

6. The system in accordance with claim 5 in which said dispensing closure is a two-piece assembly that includes
a body for mounting to said container, said body defining at least said first and second dispensing regions; and
a top that is mounted to said body and that includes said first and second lids, said top including (A) a stationary central panel anchored to said body, (B) a first hinge connecting said first lid to said central panel, and (C) a second hinge connecting said second lid to said central panel.

7. A dispensing closure system for a container that has an interior where a product may be stored, said dispensing closure system comprising:

(A) a body for accommodating communication with said container interior and including (1) a deck having at least (a) a first dispensing region defining at least one aperture from which product can be dispensed, and (b) a second dispensing region defining at least one aperture from which product can be dispensed, and (2) at least two protuberances that each (a) are located above the elevation of said deck, and (b) project laterally;

(B) at least a first lid that (1) is associated with said first dispensing region, (2) is pivotable between (a) a closed position occluding said first dispensing region aperture, and (b) a fully open position away from said closed position to permit dispensing of product from the container through said first dispensing region aperture, and (3) defines two lateral margins for each engaging and being forced past one said protuberances as said first lid is pivoted to said fully open position where said first lid is retained unless a sufficient closing force is applied to said first lid so as to move said first lid toward said closed position and force said first lid margins past said protuberances;

(C) at least a second lid that (1) is associated with said second dispensing region, (2) is pivotable between (a) a closed position occluding said second dispensing region aperture, and (b) a fully open position away from said closed position to permit dispensing of product from the container through said second dispensing region aperture, and (3) defines two lateral margins for each engaging and being forced past one said protuberances as said second lid is pivoted to said fully open position where said second lid is retained unless a sufficient closing force is applied to said second lid so as to move said second lid toward said closed position and force said second lid margins past said protuberances; and wherein said system is a dispensing closure for a container that has an opening to the container interior, said closure being separate from, but releasably attachable to, said container around said opening;

said dispensing closure is a two-piece assembly that includes said body defining at least said first and second dispensing regions; and a top that is mounted to said body and that includes said first and second lids, said top including (A) a stationary central panel anchored to said body, (B) a first hinge connecting said first lid to said central panel, and (C) a second hinge connecting said second lid to said central panel;

said body deck has a third dispensing region defining at least one aperture from which product can be dispensed;

said top includes (1) a third lid that is associated with said third dispensing region, and (2) a third hinge connecting said third lid to said central panel for pivotable movement between (a) a closed position occluding said third dispensing region aperture, and (b) a fully open position away from said closed position to permit dispensing of product from the container through the third dispensing region aperture;

said body includes said protuberances arranged in first, second, and third pairs associated with, and adapted to engage, said first, second, and third lids, respectively; and said third lid defines two lateral margins for each engaging and being forced past one said protuberances of said third pair of protuberances as said third lid is pivoted to said fully open position where said third lid is retained unless a sufficient closing force is applied to said third lid so as to move said third lid toward said closed position and force said third lid margins past said protuberances.

8. The system in accordance with claim 4 in which said body has only two of said protuberances which are spaced-apart; and said first lid and said second lid are each adapted to be selectively moved between said closed position and said fully open position whereby each said lateral margin of each said lid can engage and move past one of said protuberances.

9. The system in accordance with claim 4 in which each said protuberance (A) is elongate, and (B) has two ends.

10. A dispensing closure system for a container that has an interior where a product may be stored, said dispensing closure system comprising:

(A) a body for accommodating communication with said container interior and including (1) a deck having at least (a) a first dispensing region defining at least one aperture from which product can be dispensed, and (b) a second dispensing region defining at least one aperture from which product can be dispensed, and (2) at least two protuberances that each (a) are located above the elevation of said deck, and (b) project laterally;

(B) at least a first lid that (1) is associated with said first dispensing region, (2) is pivotable between (a) a closed position occluding said first dispensing region aperture, and (b) a fully open position away from said closed position to permit dispensing of product from the container through said first dispensing region aperture, and (3) defines two lateral margins for each engaging and being forced past one said protuberances as said first lid is pivoted to said fully open position where said first lid is retained unless a sufficient closing force is applied to said first lid so as to move said first lid toward said closed position and force said first lid margins past said protuberances;

(C) at least a second lid that (1) is associated with said second dispensing region, (2) is pivotable between (a) a closed position occluding said second dispensing region aperture, and (b) a fully open position away from said closed position to permit dispensing of product from the container through said second dispensing region aperture, and (3) defines two lateral margins for each engaging and being forced past one said protuberances as said second lid is pivoted to said fully open position where said second lid is retained unless a sufficient closing force is applied to said second lid so as to move said second lid toward said closed position and force said second lid margins past said protuberances; and wherein said body deck has at least (A) a deck first portion defining said first dispensing region, and (B) a deck second portion defining said second dispensing region;

said body includes a raised platform that (A) is at an elevation higher than said deck first portion and said deck second portion, (B) extends between at least said deck first portion and said deck second portion, and (C) defines at least one anchor hole;

said body includes at least two upwardly projecting walls that each (A) is located adjacent said deck first portion, said deck second portion, and said platform, and (B) extends to an elevation higher than said platform;

one of said protuberances projects laterally from one of said two walls over said raised platform;

another one of said protuberances projects laterally from another one of said two walls over said raised platform;

said system includes a top that includes (A) said first lid, (B) said second lid, (C) a stationary central panel, (D) an anchor post that (1) projects from beneath said central panel, and (2) has an enlarged head which is temporarily elastically deformable for initially deforming to pass through said body raised platform anchor hole and for subsequently returning to its undeformed configuration beneath said platform to create a snap-fit engagement mounting of said central panel to said platform, (E) a first hinge connecting said central panel to said first lid, and (F) a second hinge connecting said central panel to said second lid.

11. A dispensing closure system for a container that has an interior where a product may be stored, said dispensing closure system comprising:

(A) a body for accommodating communication with said container interior and including (1) a deck having at least (a) a first dispensing region defining at least one aperture from which product can be dispensed, and (b) a second dispensing region defining at least one aperture from which product can be dispensed, and (2) at least two protuberances that each (a) are located above the elevation of said deck, and (b) project laterally;

(B) at least a first lid that (1) is associated with said first dispensing region, (2) is pivotable between (a) a closed position occluding said first dispensing region aperture, and (b) a fully open position away from said closed position to permit dispensing of product from the container through said first dispensing region aperture, and (3) defines two lateral margins for each engaging and being forced past one said protuberances as said first lid is pivoted to said fully open position where said first lid is retained unless a sufficient closing force is applied to said first lid so as to move said first lid toward said closed position and force said first lid margins past said protuberances;

(C) at least a second lid that (1) is associated with said second dispensing region, (2) is pivotable between (a) a closed position occluding said second dispensing region aperture, and (b) a fully open position away from said closed position to permit dispensing of product from the container through said second dispensing region aperture, and (3) defines two lateral margins for each engaging and being forced past one said protuberances as said second lid is pivoted to said fully open position where said second lid is retained unless a sufficient closing force is applied to said second lid so as to move said second lid toward said closed position and force said second lid margins past said protuberances; and wherein said body deck has at least (A) a deck first portion defining said first dispensing region, and (B) a deck second portion defining said first dispensing region, and (C) a deck second portion defining said second dispensing region;

said body includes a raised platform that (A) is at an elevation higher than said deck first portion and said deck second portion, (B) extends between at least said deck first portion and said deck second portion, and (C) defines one anchor recess with a annular snap-fit retention bead;

said body includes at least two upwardly projecting walls that each (A) is located adjacent said platform, and (B) extends to an elevation higher than said platform;

one of said protuberances projects laterally from one of said two walls over said raised platform;

said system includes a top that includes (A) said first lid, (B) said second lid, (C) a stationary central panel, (D) an anchor post that (1) projects from beneath said central panel, and (2) has an annular bead for cooperating with said anchor post retention bead to create a snap-fit engagement mounting of said central panel to said platform when said anchor post is inserted into said anchor recess, (E) a first hinge connecting said central panel to said first lid, and (F) a second hinge connecting said central panel to said second lid.

12. The system in accordance with claim 11 in which said body deck defines a deck third portion defining a third dispensing region that defines at least one aperture from which product can be dispensed;

said body includes three of said upwardly projecting walls such that (A) a first one of said upwardly projecting walls (1) is located adjacent said deck first portion, said deck second portion, and said platform, and (2) extends to an elevation higher than said platform;

(B) a second one of said upwardly projecting walls (1) is located adjacent said deck second portion, said deck third portion, and said platform, and (2) extends to an elevation higher than said platform;

(C) a third one of said upwardly projecting walls (1) is located adjacent said deck third portion, said deck first portion, and said platform, and (2) extends to an elevation higher than said platform;

(D) each of said three upwardly projecting walls has two inner end faces that diverge from each other;

one of said protuberances projects from one of said inner end faces over said body raised platform and over said top central panel;

said top includes (A) a third lid that is associated with said third dispensing region; and (B) a third hinge connecting said third lid to said central panel so that said third lid is pivotable between a closed position occluding said first dispensing region aperture and a fully open position away from said closed position to permit dispensing of product from the container through the third dispensing region aperture; and said third lid defines two lateral margins for each engaging and being forced past one of said protuberances as said third lid is pivoted to said fully open position where said third lid is retained unless a sufficient force is applied to said third lid so as to move said third lid toward said closed position and force said third lid margins past said protuberances.

13. A dispensing closure system for a container that has an interior where a product may be stored, said dispensing closure system comprising:

(A) a body for accommodating communication with said container interior and including (1) a deck having (a) a deck first portion that includes a first dispensing region defining at least one aperture from which product can be dispensed, and (b) a deck second portion that includes a second dispensing region defining at least one aperture from which product can be dispensed;

(2) a raised platform that (a) is at an elevation higher than said deck first portion and said deck second portion, (b) extends between at least said deck first portion and said deck second portion, and (c) defines at least one anchor hole;

(3) a pair of spaced-apart, upwardly projecting walls that each (a) is located adjacent said deck first portion, said deck second portion, and said platform, and (b) extends to an elevation higher than said platform;

(4) a first protuberance projecting laterally from one of said pair of projecting walls over said raised platform;

(5) a second protuberance projecting laterally from the other one of said pair of projecting walls over said raised platform;

(B) a top that is mounted to said body and that includes (1) a stationary central panel;

(2) an anchor post that (a) projects from beneath said central panel, and (b) has an enlarged head which is temporarily elastically deformable for initially deforming to pass through said body raised platform anchor hole and for subsequently returning to its undeformed configuration beneath said platform to create a snap-fit engagement mounting of said central panel to said platform;

(3) a first lid that (a) is associated with said first dispensing region, (b) is hingedly connected to said central panel, (c) is pivotable between (i) a closed position occluding said first dispensing region aperture, and (ii) a fully open position away from said closed position to permit dispensing of product from the container through said first dispensing region aperture, and (d) defines first and second lateral margins for each engaging and being forced past said first and second protuberances, respectively, as said first lid is pivoted to said fully open position where said first lid is retained unless a sufficient closing force is applied to said first lid so as to move said first lid toward said closed position and force said first lid margins past said protuberances; and (4) a second lid that (a) is associated with said second dispensing region, (b) is hingedly connected to said central panel, (c) is pivotable between (i) a closed position occluding said second dispensing region aperture, and (ii) a fully open position away from said closed position to permit dispensing of product from the container through said second dispensing region aperture, and (d) defines first and second lateral margins for each engaging and being forced past said first and second protuberances, respectively, as said second lid is pivoted to said fully open position where said second lid is retained unless a sufficient closing force is applied to said second lid so as to move said second lid toward said closed position and force said second lid margins past said protuberances.

14. A dispensing closure system for a container that has an interior where a product may be stored, said dispensing closure system comprising:

(A) a body for accommodating communication with said container interior and including (1) a deck having (a) a deck first portion that includes a first dispensing region defining at least one aperture from which product can be dispensed, and (b) a deck second portion that includes a second dispensing region defining at least one aperture from which product can be dispensed:

(2) a raised platform that (a) is at an elevation higher than said deck first portion and said deck second portion, (b) extends between at least said deck first portion and said deck second portion, and (c) defines one anchor recess with a annular snap-fit retention bead;

(3) a pair of spaced-apart, upwardly projecting walls that each (a) is located adjacent said deck first portion, said deck second portion, and said platform, and (b) extends to an elevation higher than said platform;

(4) a first protuberance projecting laterally from one of said pair of projecting walls over said raised platform;

(5) a second protuberance projecting laterally from the other one of said pair of projecting walls over said raised platform;

(B) a top that is mounted to said body and that includes (1) a stationary central panel;

(2) an anchor post that (a) projects from beneath said central panel, and (b) has an annular bead for cooperating with said anchor post retention bead to mount said central panel to said platform with a snap-fit engagement when said anchor post is inserted into said anchor recess;

(3) a first lid that (a) is associated with said first dispensing region, (b) is hingedly connected to said central panel, (c) is pivotable between (i) a closed position occluding said first dispensing region aperture, and (ii) a full open position away from said closed position to permit dispensing of product from the container through said first dispensing region aperture, and (d) defines first and second lateral margins for each engaging and being forced past said first and second protuberances, respectively, as said first lid is pivoted to said fully open position where said first lid is retained unless a sufficient closing force is applied to said first lid so as to move said first lid toward said closed position and force said first lid margins past said protuberances; and (4) a second lid that (a) is associated with said second dispensing region, (b) is hingedly connected to said central panel, (c) is pivotable between (i) a closed position occluding said second dispensing region aperture, and (ii) a fully open position away from said closed position to permit dispensing of product from the container through said second dispensing region aperture, and (d) defines first and second lateral margins for each engaging and being forced past said first and second protuberances, respectively, as said second lid is pivoted to said fully open position where said second lid is retained unless a sufficient closing force is applied to said second lid so as to move said second lid toward said closed position and force said second lid margins past said protuberances.

15. The system in accordance with claim 14 in which each said protuberance (A) is elongate, and (B) has two ends which each defines a camming surface for initially engaging and guiding one of said lateral margins of one of said lids.

* * * * *